US009038558B2

(12) United States Patent
Balleraud et al.

(10) Patent No.: US 9,038,558 B2
(45) Date of Patent: May 26, 2015

(54) YOKE DAMPING SYSTEM

(75) Inventors: Pierre Balleraud, Nice (FR); Jean-Robert Fournier, Nice (FR)

(73) Assignee: SINGLE BUOY MOORINGS INC., Marly (CH)

( * ) Notice: Subject to any disclaimer, the term of this patent is extended or adjusted under 35 U.S.C. 154(b) by 73 days.

(21) Appl. No.: 14/004,508

(22) PCT Filed: Feb. 9, 2012

(86) PCT No.: PCT/EP2012/052176

§ 371 (c)(1), (2), (4) Date: Sep. 26, 2013

(87) PCT Pub. No.: WO2012/123191

PCT Pub. Date: Sep. 20, 2012

(65) Prior Publication Data

US 2014/0014017 A1 Jan. 16, 2014

(30) Foreign Application Priority Data

Mar. 11, 2011 (EP) ..... 11157955

(51) Int. Cl.

| | |
|---|---|
| ***B63B 21/00*** | (2006.01) |
| ***B63B 22/02*** | (2006.01) |
| ***B63B 27/34*** | (2006.01) |
| ***B63B 39/03*** | (2006.01) |
| *B63B 35/44* | (2006.01) |

(52) U.S. Cl.

CPC ..... *B63B 21/00* (2013.01); *B63B 22/025* (2013.01); *B63B 27/34* (2013.01); *B63B 39/03* (2013.01); *B63B 2035/448* (2013.01)

(58) Field of Classification Search

USPC ..... 114/230.15, 230.19
IPC ..... B63B 2021/001,2021/002
See application file for complete search history.

(56) References Cited

U.S. PATENT DOCUMENTS

| | | | | |
|---|---|---|---|---|
| 4,029,039 | A * | 6/1977 | van Heijst | 441/3 |
| 4,254,728 | A * | 3/1981 | Patinet | 114/230.15 |
| 4,351,260 | A * | 9/1982 | Tuson et al. | 114/230.14 |
| 4,494,475 | A * | 1/1985 | Eriksen | 114/230.14 |
| 7,107,925 | B2 * | 9/2006 | Wille et al. | 114/230.15 |
| 7,610,934 | B2 | 11/2009 | Naciri et al. | |

(Continued)

FOREIGN PATENT DOCUMENTS

| | | |
|---|---|---|
| GB | 1 554 881 | 10/1979 |
| WO | 2007/096019 | 8/2007 |

OTHER PUBLICATIONS

International Search Report dated Mar. 30, 2012, corresponding to PCT/EP2012/052176.

*Primary Examiner* — Stephen Avila
(74) *Attorney, Agent, or Firm* — Young & Thompson

(57) ABSTRACT

A mooring system for a floating structure (1) in which a floating structure or fixed tower is provided with a turntable (80). A floating structure is moored to the turntable via at least one rigid arm (51,51') and two tension members (41, 41'). The rigid arm is provided on one end with a ballast weight (61, 61') and includes a damping system formed of least two separated liquid tanks (70, 70') that are partly filled with liquids and placed at the same distance from the horizontal center line (100). The tanks (70, 70') are fluidly connected with each other so that liquid can be exchanged between the tanks damps a swinging yaw motion of the rigid arm (51, 51') around the vertical axis of the turntable (80).

16 Claims, 5 Drawing Sheets

(56) References Cited

U.S. PATENT DOCUMENTS

2004/0094082 A1* 5/2004 Boatman et al. ..... 114/249
2004/0237868 A1* 12/2004 Poldervaart et al. ..... 114/230.15
2006/0233629 A1* 10/2006 Naciri et al. ..... 414/137.9
2007/0289517 A1* 12/2007 Poldervaart et al. ..... 114/230.15
2012/0285358 A1* 11/2012 Yao et al. ..... 114/230.13

* cited by examiner

YOKE DAMPING SYSTEM

FIELD OF THE INVENTION

The invention relates to a mooring system for a floating structure, such as a vessel, comprising a mooring structure, such as a buoy, a further floating structure or a fixed tower, having a turntable rotatable around a vertical axis, and a connection structure adapted to provide a connection between the floating structure and the mooring structure, the connection structure comprising one rigid arm assembly and tension members wherein the rigid arm is provided with two ballast weights and wherein the rigid arm and the tension members at one end are hingedly interconnected and at their other ends are adapted to be connected to the mooring structure and the floating structure respectively or reverse.

The invention also relates to a damping device for such a mooring system and to an offshore transfer system having such a mooring device.

BACKGROUND OF THE INVENTION

U.S. Pat. No. 7,610,934, that was filed by the applicant, describes an offshore transfer system comprising an articulated yoke mooring system having a first structure with a vertical first arm and a second arm and a damping mechanism acting on the second arm for damping movement of the second arm around the articulation joint between the two arms upon transition of the second arm from an operative position to an inoperative position after disconnecting the releasable connector from a second structure. In the present invention the damping device relates to a damping device counteracting motions due to roll, pitch and yaw on the mooring system when connected in the operative position.

The international patent application WO2007096019, discloses a system having a connection structure adapted to provide a connection between a floating structure, and a mooring structure having a turntable rotatable around a vertical axis of the mooring structure. A rigid arm assembly and a set of pendulums are located at one end of the connection structure. In this prior art, a damping system damps the swinging motion of the pendulums. The damping system comprises a tank having dimensions and containing a predetermined amount of liquid such that the liquid is adapted to move in the tank due to the swinging motion of the pendulum members. This results in a liquid wave or travelling water bullet providing slamming impact and inertia forces creating a tank reaction force that is counteracting the swinging motion of the pendulum members thereby causing damping of the swinging motion of the pendulum members.

However in this solution the damping is only efficient once the acceleration of the trapped fluid is sufficient. Further, using a sloshing force (water displacement due to wave propagation) and slamming forces as damping forces, results in large structural loads in the system. In fact, the forces created within the tank are huge and hence the system has to be robust enough to withstand repeated strong impacts. The sloshing tanks further have several response modes and can thus provoke spurious excitation. Another disadvantage of this known solution is that the water level in the tanks shall be low, so that large tank footprints are required.

SUMMARY OF THE INVENTION

It is an object of the present invention to provide an improved, more efficient damping system having a smaller footprint which is also easier to design as the damping fluid's behavior is controlled. It is a further object of the present invention is to provide a mooring system for a floating structure, such as a vessel, comprising a mooring structure, such as a buoy, a further floating structure or a fixed tower, having a turntable rotatable around a vertical axis, and a connection structure adapted to provide a connection between the floating structure and the mooring structure, the connection structure comprising one rigid arm assembly and tension members wherein the rigid arm is provided with two ballast weights and wherein the rigid arm and the tension members at one end are hingedly interconnected and at their other ends are adapted to be connected to the mooring structure and the floating structure respectively or reverse, wherein the rigid arm comprises a damping system, the damping system comprising at least two separated liquid tanks that are partly filled with liquids and placed at the same distance from the vertical axis, the tanks are fluidly connected with each other so that liquid can be exchanged between the tanks to damp a swinging motion of the rigid arm around the vertical axis of the turntable. The principle of the present invention is not based on sloshing but on the displacement of mass from one tank to the other via a connecting channel. In the present invention, the damping system uses inertia forces (water displacement within a tube) as damping forces. The system takes advantage of the yoke width to travel the water and has a single response mode that is tuned at the yoke oscillations natural frequency.

BRIEF DESCRIPTION OF THE DRAWINGS

The invention will be further described below in connection with exemplary embodiments with reference to the accompanying drawings, wherein

According to FIGS. 1 and 2 the vessel 1 is moored to a single point mooring structure comprising a tower structure 4 having a foundation structure anchored by means of one or more anchor piles to the sea bed. The tower carries a turntable 8 which is free to rotate about its vertical axis 9. The mooring structure uses a rigid arm assembly 10 comprising two triangular structures 11, 12 each connected to a supporting structure 17 with their basis by means of hinges. In FIG. 1 the supporting structure 17 is carried by the bow 18 of the vessel 1. The axes of the hinges are in principle horizontal.

In FIGS. 1 and 2, the apexes of the structures 11, 12 respectively are connected to ballast weights 21, 22 and to tension members or pendulum members 23, 24.

In FIG. 1 pendulum members 23, 24 are with their other ends connected to the turntable 8. These tension members can be chains but the figures show an embodiment in which they are tubular members and their interconnections comprise hinges of which only the hinges for tension member 24 are shown and denoted by reference numerals 27, 28, 29. Hinges 27 and 29 have horizontal, mutually parallel axes, the axe of hinge 28 is also horizontal but perpendicular to the other two.

In FIG. 2 the connection structure comprises two pendulum members 23, 24 each connected by a hinge assembly (not shown) to support arms 5, 6 mounted on the floating structure 1. At their lower ends the pendulum members 23, 24 are connected by hinge assemblies 2 to the ballast weights 21, 22, thereby providing an interconnection between the ends of the pendulum members 23, 24 and the two triangular structures or yokes 11, 12. The hinge assemblies at the upper and lower ends of the pendulum members 23, 24 provide two perpendicular hinge axes allowing movement of these pendulum members in all directions.

Figure 1:
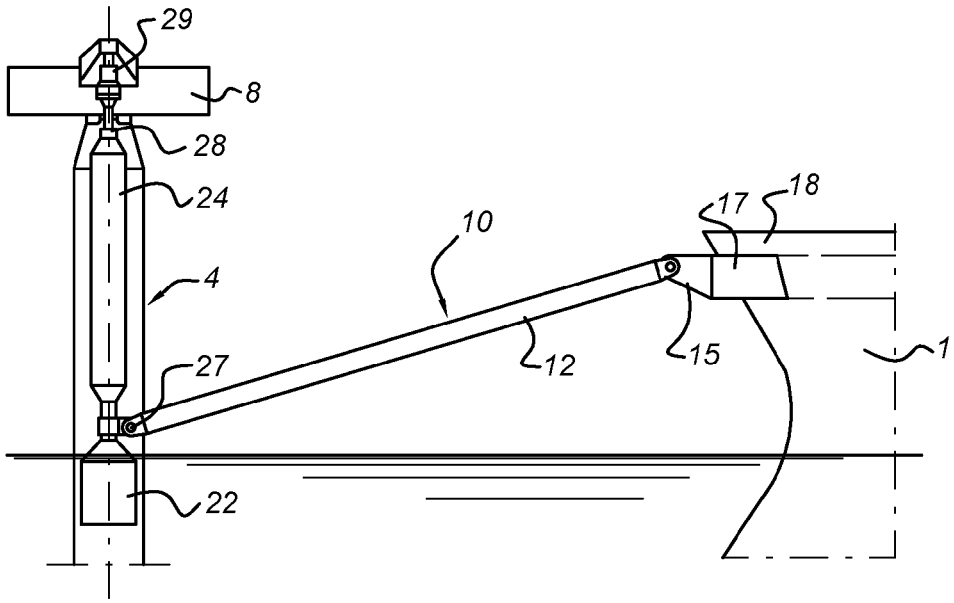
Fig. 1 prior art
FIG. 1 shows a side view of part of a known mooring structure, FIG. 2 schematically shows a perspective top view of a known mooring system.
Figure 2:
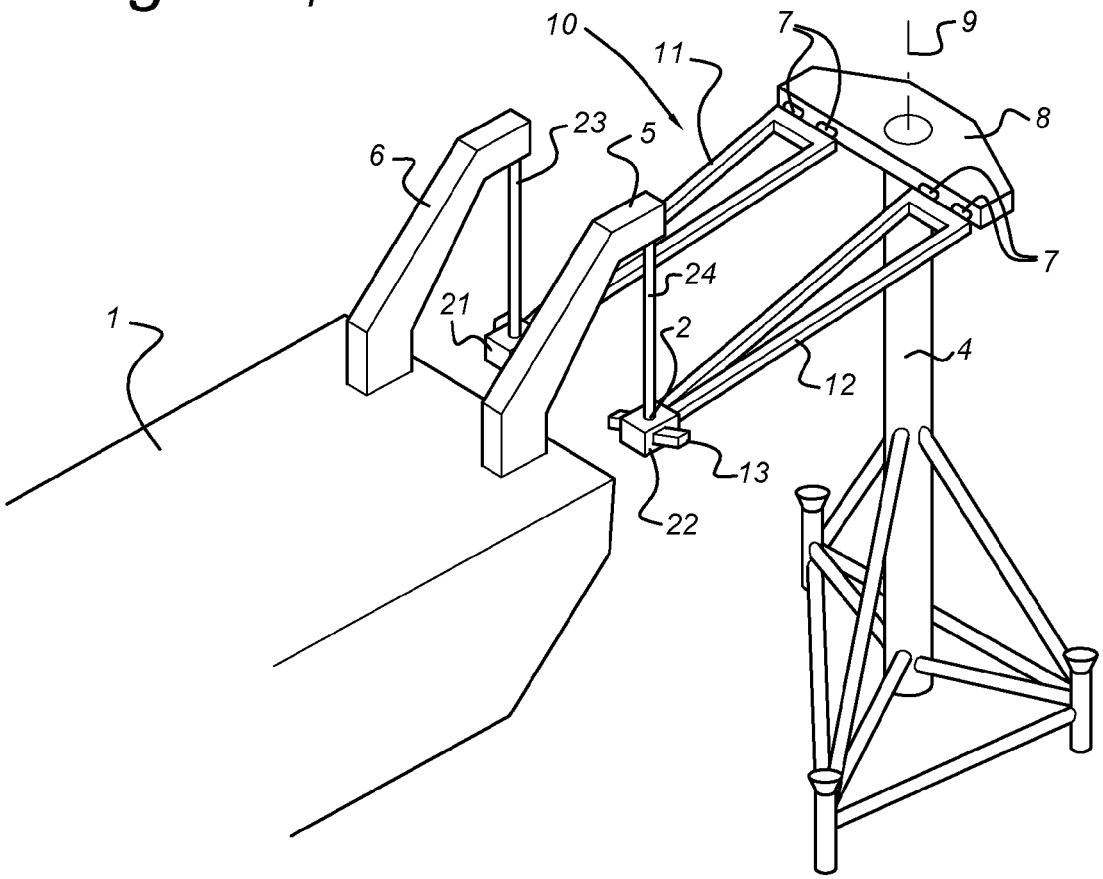
Fig. 2 prior art

In the embodiment shown in FIG. 2, each ballast weight 21, 22 includes a tank 13 containing a liquid, for example seawater. The dimensions of the tank 13 and the amount of liquid are chosen such that the liquid is adapted to move in the tank 13 due to the swinging motion of the pendulum members 23, 24.

Figure 3A:
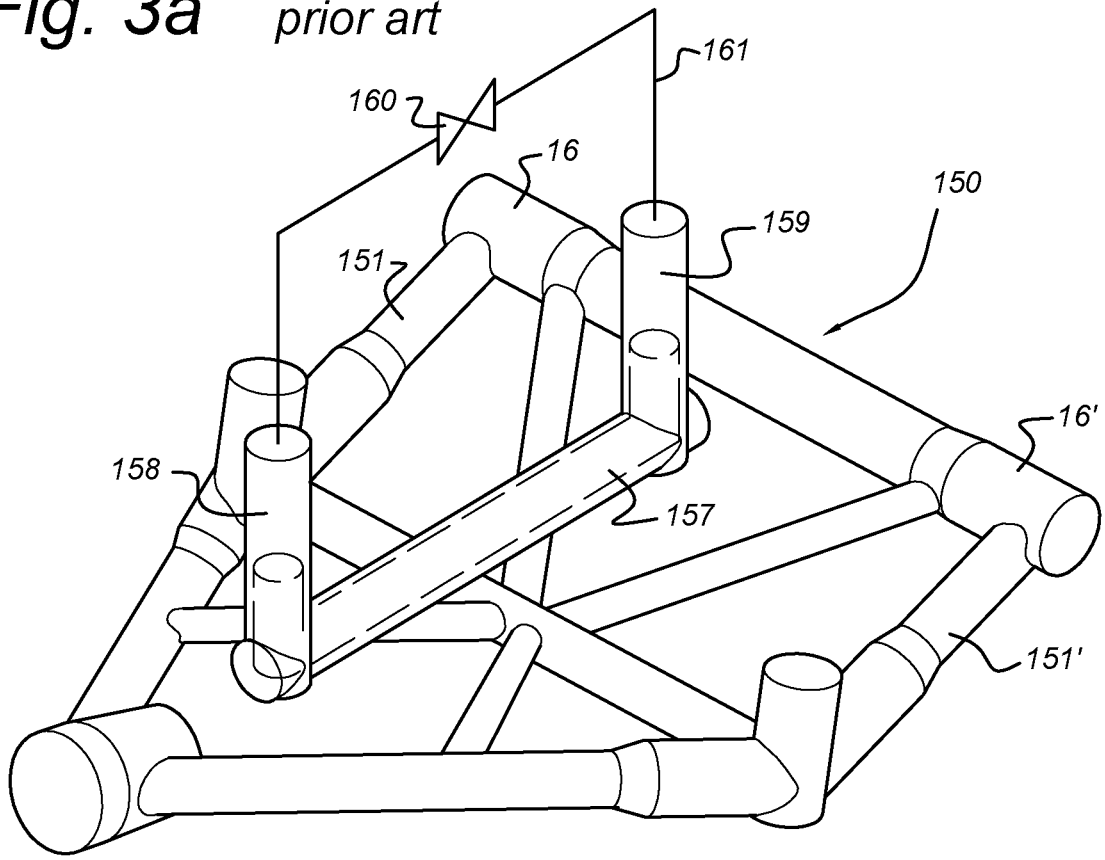
Fig. 3a prior art
FIG. 3*a* shows a known damping system to counteract the movement due to disconnection from the mooring system, comprising communicating U-tubes.
Figure 3B:
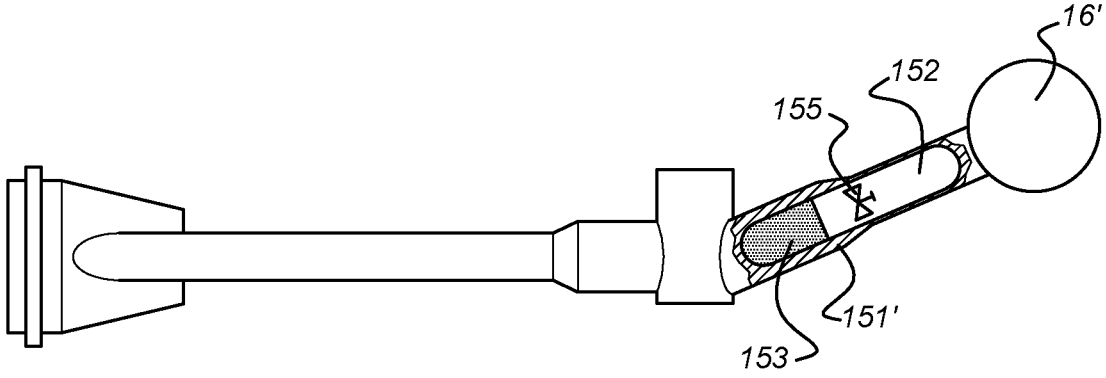
Fig. 3b prior art
FIG. 3*b* shows a known damping system to counteract the movement due to disconnection from the mooring system comprising a moving solid mass.

FIGS. 3*a* and 3*b* both show a known damping system to counteract the movement due to disconnection from the mooring system, each using a particular principle.

FIG. 3*a* shows a U-tube damping construction, wherein a horizontal channel 157 is attached to two transverse channels 158, 159. The transverse channels 158, 159 are equipped with an air-flow control valve 160 in an interconnecting air duct 161 which controls air flow between the tubes 158, 159. When the A-frame 150 is disconnected from the vessel, the liquid will flow from the tube 158 to the lowered tube 159. When the counterweight 16, 16' is ascending, the flow of liquid in the channels 157, 158 and 159 will generate a counteracting inertia which will dampen the oscillatory motion. The frequency of the motion of the liquid in the channels 157-159 can be determined by the cross section of the channels and by opening and closing of the air-flow control valve 160.

In FIG. 3*b* a solid mass 153 is slidably received in channels in short arms 151,151' of the A-frame 150. A lubrication system is provided to introduce oil in the channel to improve sliding of the weight 153.

Figure 4:
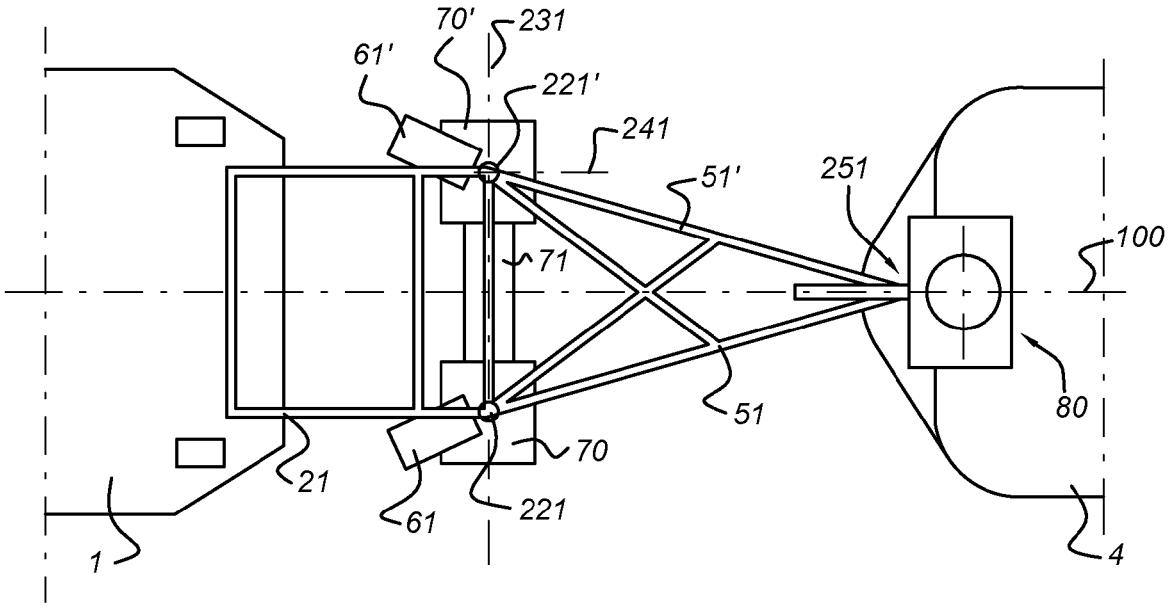
FIG. 4 shows a top view of the mooring system according to the present invention.
Figure 5:
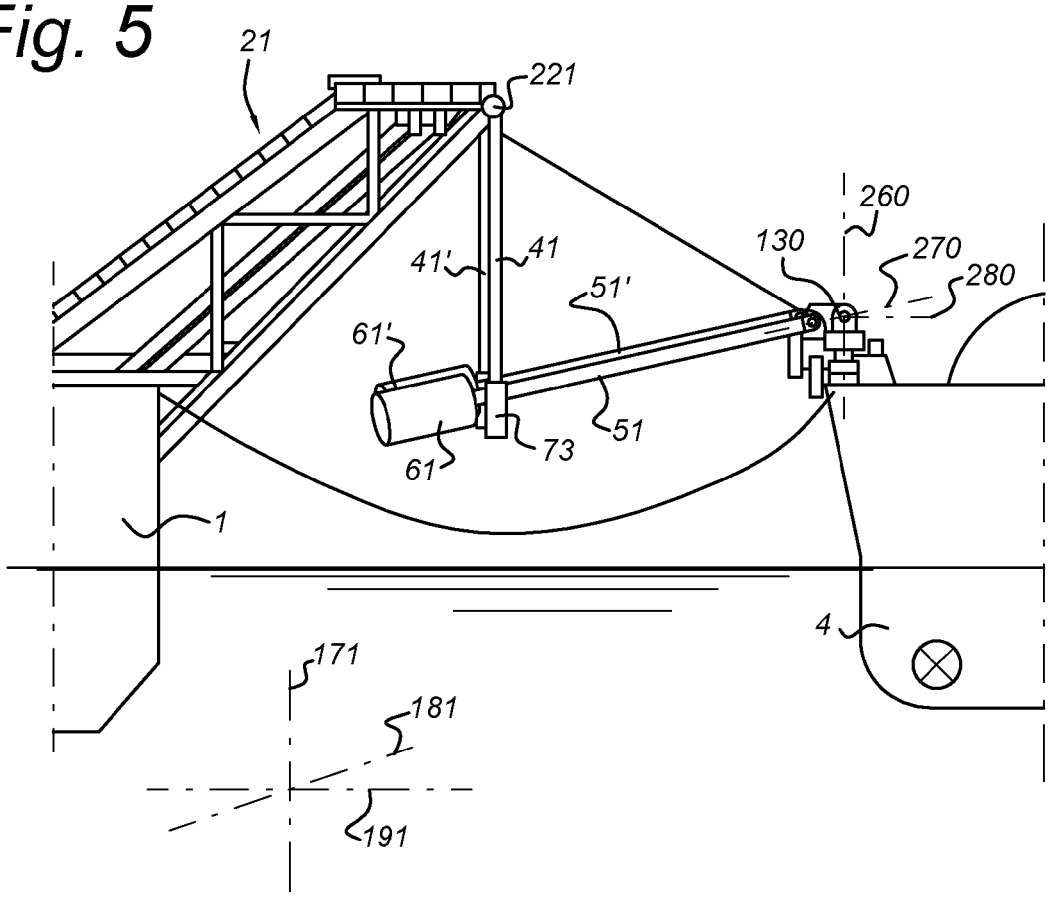
FIG. 5 shows a side view of the mooring system according to the present invention.

FIG. 4 shows a top view of the mooring system according to the present invention and FIG. 5 shows a side view of the mooring system according to the present invention. In these figures the horizontal mooring arm is made of two parts 51, 51' which are each connected to a respective vertical arm 41, 41' or tensioning member via articulation joints (not shown). Two counterweights 61, 61' are connected to end parts of each arm part 51, 51'. The articulation joints may for instance comprise three perpendicular circular bearings, or ball-joints allowing rotation around a vertical axis 171 (yaw), a transverse axis 181 (pitch) and a longitudinal axis 191 (roll).

The vertical mooring arms 41, 41' are at their upper ends connected to the support structure 21 in articulation joints 221, 221' allowing rotation of the arms 41, 41' around a transverse axis 231 and a longitudinal axis 241. At the coupling end part 251, the arm parts, 51, 51' are provided with the mechanical connector 130 allowing rotation around a vertical axis 260 (yaw), a longitudinal axis 270 (roll) and a transverse axis 280 (pitch). The mechanical connector is not shown in detail but may be formed by a construction such as described in U.S. Pat. No. 4,876,978 in the name of the applicant, which is incorporated herein by reference.

During yaw-movements of the vessel 1, a good control and sufficient yaw-stiffness is achieved by the arm parts, 51, 51' connected to the counterweights 61, 61'. Yaw displacement (in the horizontal plane) of the LNG-carrier will be counteracted by a restoring moment created by the counterweights 61, 61'. By separating the mooring function and the fluid transfer function, a simplified and proven cryogenic transfer system (not shown) can be achieved using state of the art components and resulting in reduced and simplified maintenance.

In those figures it is clearly shown that the rigid arm parts, 51, 51' comprise a damping system, the damping system comprising at least two separated liquid tanks 70, 70' that are partly filled with liquids and placed at the same distance from the horizontal central axis 100. The tanks are fluidly connected with each other so that liquids can be exchanged between the tanks 70, 70' to damp a swinging motion of the rigid arm parts, 51, 51' around the vertical axis of the turntable 80.

The damping system is provided at the interconnected ends of the rigid arm parts, 51, 51' and tension members 41, 41'.

According to the invention, the two interconnected liquid tanks 70, 70' are interconnected via a connecting channel 71 having a free surface such that the damping liquid is flowing from side-to-side with the proper phase to reduce motions created on the tension members 41, 41'. The connecting channel is oriented around a substantially horizontal axis.

For clarity reasons the transfer system is not shown in the figures, but pipes are attached to the mechanical connector 130. Transfer pipes are connected to the support structure 21 in articulation joints and can pivot around a substantially longitudinal axis. The pipes are connected to the mechanical connector 130 in articulation joints and can pivot around a longitudinal, a transverse and a vertical axis. The pipes can move independently of the mooring arms 41, 41', 51, 51'.

Figure 6A:
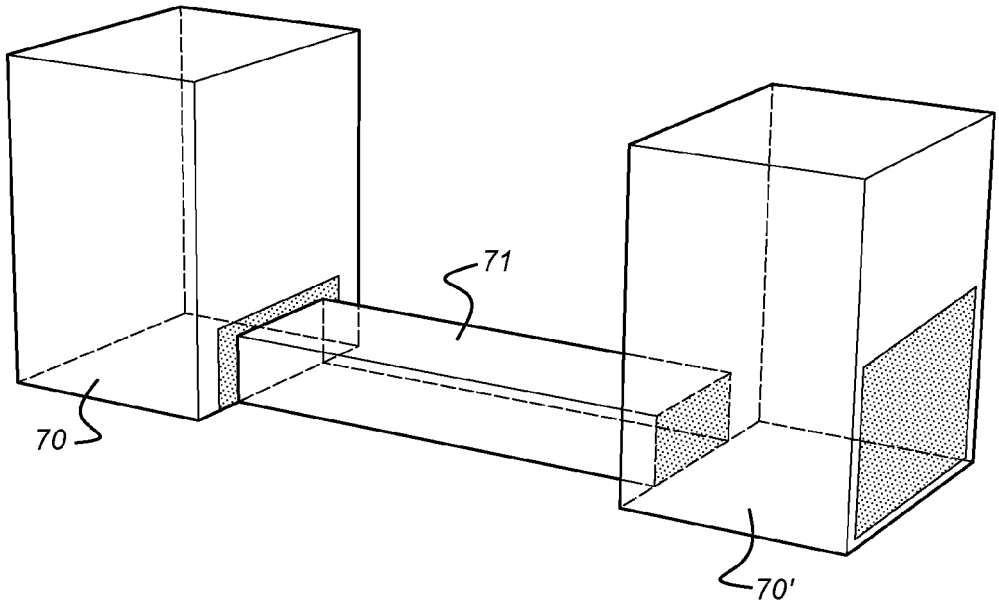
FIG. 6*a* shows the two tanks of the damping deice according to the present invention interconnected via a connecting channel.
Figure 6B:
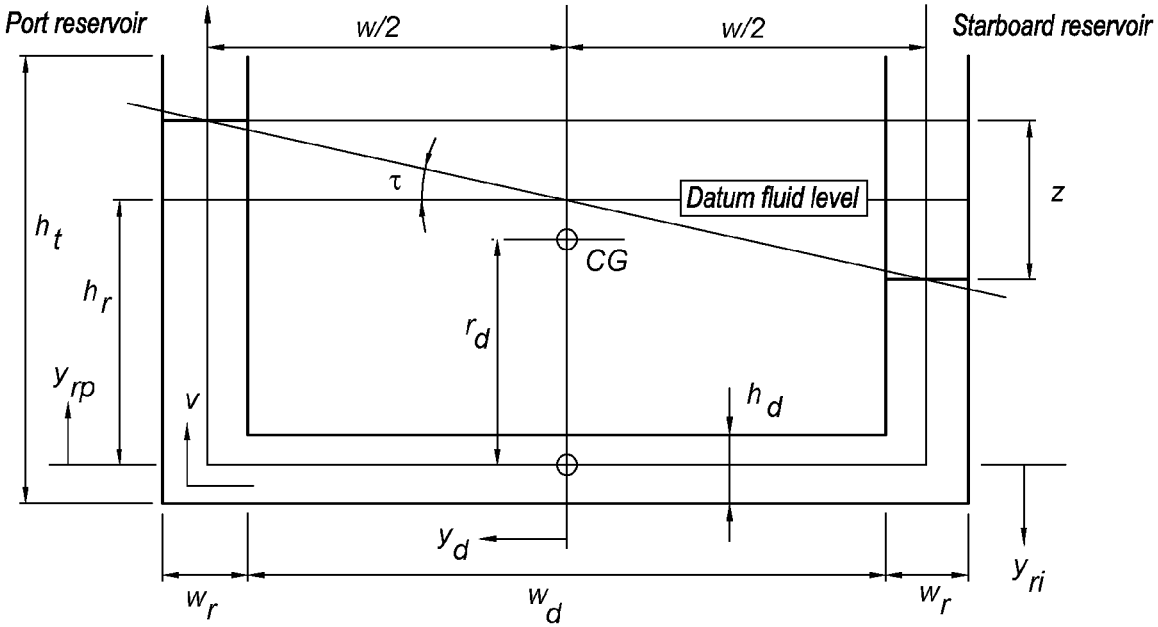
FIGS. 6*b* and 6*c* show a U-tube tank and its geometric parameters.

FIG. 6*a* shows the two tanks of the damping device according to the present invention interconnected via a connecting channel. In the present invention the damping liquid is movable from one tank to the other as in a U-tube, the mass of the damping liquid being accelerated due to the yaw effect of the floating structure. Such a configuration enables to have a single mode of response on the damping system; the displacement is done in a controlled manner. With this configuration it is possible to simply monitor the "U-tube" flow rate. In another embodiment, the tanks and connecting channel are integrated within the ballast weight of the rigid arm.

Figure 6C:
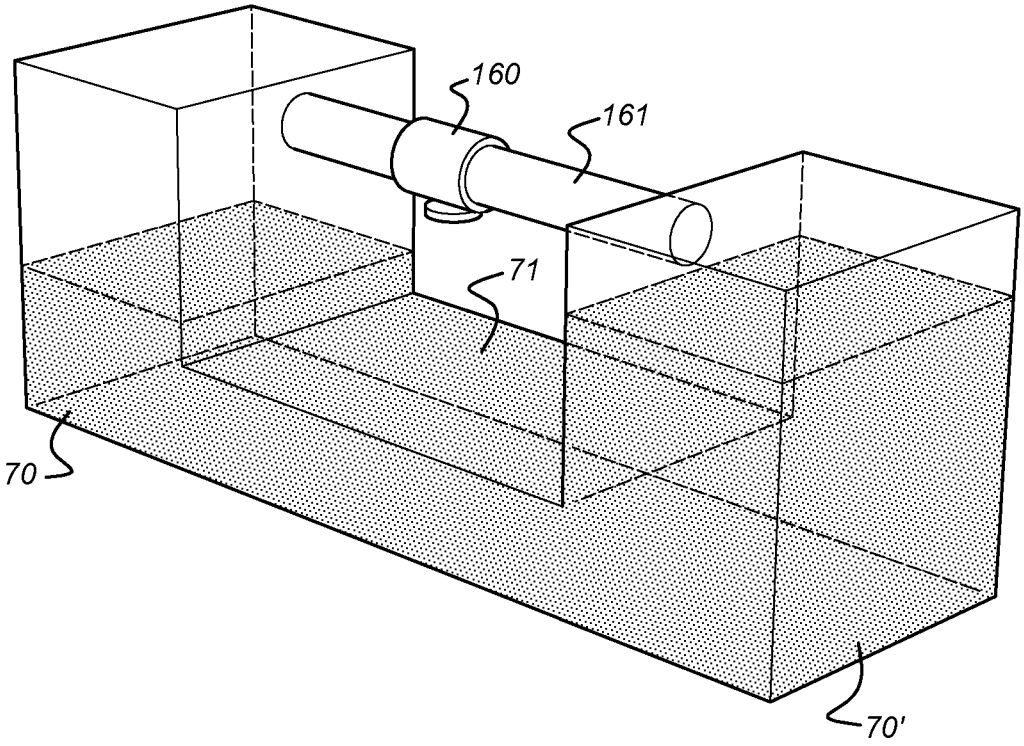

In FIG. 6*c* a valve within a gas exchange pipe between the two tanks, located above water level within the damping system is shown. This ensures a controlled circulation of fluid within the damping system. Such a valve in an embodiment not shown could be placed in the connecting channel 71 so to control the fluid movement.

Although particular embodiments of the invention have been described and illustrated herein, it is recognized that modifications and variations may readily occur to those skilled in the art, and consequently, it is intended that the claims be interpreted to cover such modifications and equivalents.

The invention claimed is:

1. Mooring system for a floating structure (1), such as a vessel, comprising a mooring structure (4), such as a buoy, a further floating structure or a fixed tower, having a turntable (80) situated on a horizontal centre line (100) and rotatable around a vertical axis (260), and a connection structure adapted to provide a connection between the floating structure (1) and the mooring structure (4), the connection structure comprising at least one rigid arm (51,51') and two tension members (41, 41'), wherein the rigid arm (51,51') is provided with a ballast weight (61, 61') and wherein the rigid arm (51,51') and the tension members (41, 41') at one end are hingedly interconnected and at their other ends are adapted to be connected to the mooring structure (4) and the floating structure (1) respectively or reverse, characterized in that the rigid arm comprises a damping system, the damping system comprising at least two separated liquid tanks (70, 70') that are partly filled with liquids and placed at the same distance from the horizontal centre line (100), the tanks (70, 70') being fluidly connected with each other so that liquid can be exchanged between the tanks to damp a swinging motion of the rigid arm (51, 51') around the vertical axis of the turntable (80).

2. Mooring system according to claim 1, wherein the mass of the damping liquid moved from one tank to the other is being accelerated due to the yaw effect of the floating structure.

3. Mooring system according to claim 1, wherein the damping system is provided with at least two interconnected liquid tanks (70, 70') interconnected via a connecting channel (71) having an open cross-sectional surface such that the damping liquid is flowing from side-to-side with the proper phase to reduce motions created on the tension members (41, 41').

4. Mooring system according to claim 3, wherein the connecting channel of the damping system is provided at the interconnected ends of the rigid arm (51, 51') and tension members (41, 41').

5. Mooring system according to claim 3, wherein the connecting channel (71) between the at least two tanks (70, 70') of the damping system is oriented along a substantially horizontal axis.

6. Damping system for a mooring system according to claim 3, wherein the connecting channel (71) between the at least two tanks (70, 70'), has a free cross-sectional surface and a shape that allows the damping liquid in the tanks to flow from side-to-side with the proper phase to reduce motions created on the tension members.

7. Damping system according to claim 6, wherein the tanks and connecting channel are integrated within the ballast weight of the rigid arm.

8. Damping system according to claim 6, wherein a valve is provided in between the at least two tanks to regulate the fluid movement within the system.

9. Offshore transfer system comprising a mooring system according to claim 1.

10. Mooring system according to claim 2, wherein the damping system is provided with at least two interconnected liquid tanks (70, 70') interconnected via a connecting channel (71) having an open cross-sectional surface such that the damping liquid is flowing from side-to-side with the proper phase to reduce motions created on the tension members (41, 41').

11. Mooring system according to claim 10, wherein the connecting channel of the damping system is provided at the interconnected ends of the rigid arm (51, 51') and tension members (41, 41').

12. Mooring system according to claim 4, wherein the connecting channel (71) between the at least two tanks (70, 70') of the damping system is oriented along a substantially horizontal axis.

13. Mooring system according to claim 11, wherein the connecting channel (71) between the at least two tanks (70, 70') of the damping system is oriented along a substantially horizontal axis.

14. Damping system for a mooring system according to claim 4, wherein the connecting channel (71) between the at least two tanks (70, 70'), has a free cross-sectional surface and a shape that allows the damping liquid in the tanks to flow from side-to-side with the proper phase to reduce motions created on the tension members.

15. Damping system for a mooring system according to claim 5, wherein the connecting channel (71) between the at least two tanks (70, 70'), has a free cross-sectional surface and a shape that allows the damping liquid in the tanks to flow from side-to-side with the proper phase to reduce motions created on the tension members.

16. Damping system according to claim 7, wherein a valve is provided in between the at least two tanks to regulate the fluid movement within the system.

* * * * *